United States Patent [19]

Evasick et al.

[11] Patent Number: 4,875,451

[45] Date of Patent: Oct. 24, 1989

[54] DIESEL TUNE UP METHOD

[76] Inventors: Robert J. Evasick; Edward J. Evasick, both of 337 E. San Ysidro Blvd., Unit "E", San Ysidro, Calif. 92073

[21] Appl. No.: 218,942

[22] Filed: Jul. 14, 1988

[51] Int. Cl.[4] ..... F02M 61/14

[52] U.S. Cl. ..... 123/435; 123/305; 123/445

[58] Field of Search ..... 123/435, 445, 305

[56] References Cited

FOREIGN PATENT DOCUMENTS 2149535 6/1985 United Kingdom ..... 123/435

*Primary Examiner*—Andrew M. Dolinar

*Attorney, Agent, or Firm*—Ralph S. Branscomb

[57] ABSTRACT

A system for equalizing the performance among the cylinders of an internal combustion engine which involves the introduction of increased fuel to under-performing cylinders, and reduced fuel to over-performing cylinders, with the result that the cylinders all perform at a more uniform level. In the first embodiment, this is achieved by means of selecting unit injectors for a diesel engine according to the cranking compression in each cylinder so that cylinders with lower compression receive more fuel. In the second embodiment, in which injectors in either diesel or gasoline engines are controlled by an electronic controller, temperature sensors within the individual cylinders report to the electrical control unit which then operates the injectors to meter the fuel injection such that hotter operating cylinders receive less fuel and cooler cylinders receive more. The engine is then tuned according to the engine manufacturer's standard procedures.

5 Claims, 1 Drawing Sheet

C-1-B DIESEL
TUNE-UP WORKSHEET

| | | | |
|---|---|---|---|
| 400 | 2 | 380 | 4 |
| 360 | 6 | 400 | 2 |
| 370 | 5 | 400 | 2 |
| | | | |

DIESEL TUNE UP METHOD

BACKGROUND OF THE INVENTION

The invention pertains to increasing the performance of fuel injected engines. Although traditionally this has meant diesel engines, increasingly fuel is injected in modern gasoline engines as well.

Injectors may be of the unit injector type, in which each injector actually forces fuel into the engine cylinder, or of the simple nozzle type in which the diesel fuel pressure is generated by a central pump and then ducted to the nozzles which inject them into the cylinder. In this application, all references to "injectors" mean unit injectors, not the simple nozzle injectors.

When diesel engines are rebuilt and tuned, the injectors are either replaced, or the old injectors are cleaned, rebuilt and reinstalled in the engine. Engine performance is generally improved after a rebuilding, which is reflected in a slightly lowered fuel consumption and a corresponding increase in miles per gallon of the vehicle.

When injectors are installed in a diesel engine, either originally, or after being rebuilt, they must fall within a range of flow-rates dictated by the manufacturer. For example, a particular engine might require injectors that are rated between 54 and 60 cc's, meaning that the injector will inject that volume of fuel per 1000 strokes. Thus, any injector that fell within the six cc rating range would be adequate for the engine in question. Thus, injectors falling within the range are installed in the cylinders irrespective of the particular, relative performance of any particular cylinder or cylinders.

However, the cylinders themselves also differ considerably from one to the next in the same engine in overall performance. The difference in compression between the cylinders of an engine that is working fairly well might be 30 or 40 PSI. Although ideally each cylinder should achieve about the same compression, and produce about the same power so that the power output is even throughout the entire engine cycle, diesel engines are tuned more or less roughly, with these substantial variations between cylinders being acceptable. No effort is made to match the injectors, for example, with the cylinders so that the performance of the particular injector compliments the performance of a particular cylinder so that together the cylinders all perform at about the same rate, resulting in smoother engine performance and greater mileage.

Electronically controlled injector systems control all of the injectors simultaneously based on various input data, and the central controller, or "electronic control module" (ECM) controls all of the injectors together to maximize efficiency, or power, or otherwise utilize the data to optimize engine performance.

Electronic control systems do not, however, control the fuel injected to each individual cylinder based on the temperature or pressure sensed in that cylinder. The electronic control system would thus work ideally if all of the cylinders operated at substantially identical temperatures and pressures, which of course, they were designed to do. However, in actual practice and especially over a period of time resulting in engine wear, this ideal situation by no means exists.

SUMMARY OF THE INVENTION

The invention, in its first embodiment, takes into account the above-stated deficiency in the art of tuning diesel engines. The method of tuning disclosed herein pertains primarily to two-stroke, mechanically-controlled diesel engines. However, it can also be used to tune any diesel engine using unit injectors. Electronically controlled diesel and gasoline engines are dealt with in the second embodiment. In the first embodiment, rather than ignoring the difference in compression between cylinders of the same engine when the engine is tuned, and further ignoring the differences in flow-ratings between injectors in the same set, the method instead matches the injectors to the cylinders such that high flow-rate injectors are installed on low compression cylinders, and vice-versa.

Typically, an engine that is being tuned with the method of the invention would have its injectors removed, cleaned and possibly rebuilt and then flow-rated and marked according to the results of the flow-rating test. Presumably, all of the injectors would fall within the approximately 6 cc range of flow ratings dictated by the manufacturer. Within that range, they would be designated, for example, 1 to 6, indicating whether they were at the bottom of the range, at the top of the range, or somewhere in between.

Then, each of the engine cylinders is compression checked by removing the injector from that particular cylinder and running the engine.

Once the compression of each cylinder is noted and marked down, the cylinders can be ordered according their compression rate, and then the injectors installed so that the injectors are assigned cylinders with the cylinder compression and the injector flow rating being inversely related.

In this fashion, low compression cylinders will receive the maximum injection of diesel fuel during operation, and will thus produce more power than they would if receiving a smaller amount of fuel. Conversely, the high compression cylinders would receive the least amount of fuel, which would tend to reduce their relative compression and power contribution to the crank shaft. The clear result would be an evening out of the contributions of all of the cylinders.

Then, after the injectors have been selected according to this scheme, the final tune up is completed using the standard manufacturer's procedure for the particular engine.

The second embodiment of the invention, which pertains to electronically controlled injectors, utilizes temperature transducers installed within each of the cylinders. These transducers are wired into the electronic control module, which utilizes the information from the transducers to operate the fuel injectors inversely according to the operating temperatures of the cylinders. Clearly, this is a counterpart to the first embodiment which utilized pressure, rather than temperature as the control parameter.

DETAILED DESCRIPTION OF THE PREFERRED EMBODIMENT

Figures 1, 2:
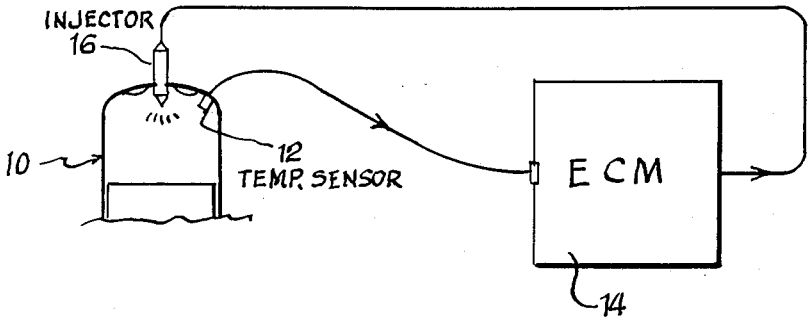
FIG. 1 illustrates a tune up work sheet used for tuning mechanically controlled diesel engines.
FIG. 2 diagrammatically illustrates an electronically controlled injector system of either the diesel or gasoline type.

The invention according to the first embodiment has been performed a number of times, and has been successful in every instance in substantially improving fuel consumption. Although a number of examples could be cited, two typical examples will be used as an indication of the rest.

The mileage of a charter bus was measured over a distance of 4,670 miles. Over this distance, the vehicle used 895.30 gallons of fuel, for an average fuel consumption of 5.21 miles per gallon.

Then the bus, which had an eight cylinder diesel engine, was tuned using the technique described herein. Subsequent to the tuning, the bus was driven for a distance of 5,235 miles. Over this distance, the bus used only 735.70 gallons of fuel, yielding an average fuel consumption of 7.11 miles per gallon. This was an improvement of over 36 %, clearly resulting in a substantial cost savings over a relatively short period of time. The engine was more responsive and powerful during the period after tuning, as well as being more economical.

In the second example, another eight cylinder bus belonging to the Gray Line of Hawaii was tuned. Before tuning, the bus consumed 553 gallons of fuel over a distance of 2,409 miles for a total miles per gallon figure of 4.3. Subsequent to the tuning, the bus traveled 2,709 miles, consuming 510 gallons for an average mileage figure of 5.3 miles per gallon. This represents an increase of almost 25 %.

As indicated in the summary of the invention, the crux of the tune-up technique is the utilization of relatively low flow-rate injectors in the relatively high compression cylinders, and vice-versa. The cylinders may differ from one another by, for example, 40 pounds per square inch maximum non-combustion compression. Ideally, for every ten pounds of compression difference, the injector should have a flow-rating of one cubic centimeter difference, or 1 cc difference per ten pounds pressure differential. The 1 cc difference is actually cumulative over a test of 1000 strokes, but would appear as 1 cc in the injector rating.

As an actual example, reference is made to FIG. 1. FIG. 1 is similar to an actual tune up work sheet used in conjunction with the instant technique. The compressions of each cylinder is written down in the appropriate square, and then an injector code is matched to it. In the example given in FIG. 1, the cylinders having the maximum compression have 400 pounds per square inch compression. This drops down to 360 in the weakest cylinder. Therefore, the weakest cylinder receives the injector with the flow-rating of 6, indicating that it is at the top of the manufacturer's permissible range. Then, for every ten pounds per square inch of compression more than the 360 pound cylinder, the injector flow-rating is increased by 1 cc, with the highest compression cylinders, with 400 pounds per square inch receiving injectors with a number two rating. This rating would be just one rating above the lowest permissible rating.

In the above example, the permissible range for the injectors might be 54 to 60 cc's. Thus, an injector code number 2 would actually be a 56 cc injector, and a number 4 code number would indicate a 58 cc rating, and so forth.

The above illustration is somewhat ideal, and assumes that there is a selection of injectors of various flow rates which will fit the engine that is being tuned. Although the injectors can be adjusted so that they could achieve a fairly precise flow rate, it is found to be adequate in most instances to leave the injectors at the flow-rate which they were found, and just reassign them to the cylinders according to the inversion scheme set forth herein.

The second embodiment of the invention pertains to electronically controlled injector systems, either diesel or gasoline powered. A diagrammatic illustration of this system is shown in FIG. 2. The electronic control module (ECM) receives data of different types and utilizes it in controlling the amount of fuel injected and the duration of the injector operation.

In the instant invention, each of the cylinders 10 of the engine has a temperature transducer 12 installed in the combustion area. The temperature transducer connects to the ECM 14, which in turn is connected to the injectors 16. Although only one injector/cylinder is shown, typically the ECM would operate four, six, or eight cylinders.

The temperature transducers provide the temperature information to the ECM, which is programed to adjust the operation of each injector 16 individually to match the amount of fuel introduced to the temperature of operation, so that the temperature in the cooler cylinders will rise while the hotter cylinders become cooler, equalizing not only the temperatures, but also the performance and power delivery of each cylinder.

Also, although the invention in its second embodiment is described strictly in terms of the unit 12 being a temperature transducer, it could also be a compression transducer. It has been described as a temperature transducer because it would ordinarily be technically considerably easier to install temperature transducers than compression sensors.

In any of the embodiments, by utilizing the concept of equalizing the temperatures or pressures in the various cylinders of an internal combustion engine, the power output of the cylinders will also be equalized. With equalization, or partial equalization, of individual cylinder power output comes improved engine performance, better mileage, and smoother and quieter engine operation. Some of the power that would otherwise be diverted causing vibration and noises and rough operation, can now be delivered directly into the vehicular drive train, with the above-stated beneficial results.

I claim:

1. A method of improving the performance of a multi-cylindered diesel engine having unit injectors by tuning, comprising the following steps:

(a) measuring the non-combustion compressions of a plurality of the cylinders of said diesel engine and noting the relative compressions of the cylinders relative to one another; and, (b) selecting and installing fuel injectors of differing flow rates, with the particular flow rate of each injector being so installed, being inversely related to the relative compression of the cylinder into which it is being installed, such that cylinders having relatively low compression are fitted with injectors having relatively high flow rates and vice-versa.

2. A method according to claim 1 wherein each of said injectors which is installed on a cylinder is one of a set of selectable injectors, and the flow rates of the injectors in said set all fall within the manufacturer's injector flow rating for the particular engine on which the injectors are being installed and step (b) includes selecting injectors from said set and subsequently following the tune up procedures established by the manufacturer of the respective engine.

3. A method according to claim 2 wherein said set of selectable injectors comprises injectors which were installed on the engine prior to tuning, and including the step, prior to step (b), of removing the injectors from the engine and flow-rating the injectors.

4. A method according to claim 3 and including the step of assigning each injector of said set of selectable injectors a number corresponding to its variation in flow rate from the others of said injectors.

5. A method according to claim 1 wherein step (a) includes selecting and installing injectors which differ from one another in flow rate by on the order of one cubic centimeter per thousand strokes, per ten pound compression variation between cylinders.

* * * * *